US005857903A

United States Patent [19]

Ramspeck et al.

[11] Patent Number: 5,857,903

[45] Date of Patent: Jan. 12, 1999

[54] ROTARY CYLINDER FOR AN EPILATING APPLIANCE

[75] Inventors: Klaus Ramspeck, Langen; Hans-Eberhard Heintke, Wächtersbach; Pedro Sanchez-Martinez, Kroberg, all of Germany

[73] Assignee: Braun Aktiengellschaft, Kronberg, Germany

[21] Appl. No.: 799,338

[22] Filed: Feb. 13, 1997

[30] Foreign Application Priority Data

Aug. 6, 1996 [DE] Germany ..... 196 31 419

[51] Int. Cl.[6] ..... A45D 26/00

[52] U.S. Cl. ..... 452/82; 452/83; 452/84; 606/133

[58] Field of Search ..... 452/82, 83, 84, 452/85; 606/133, 131

[56] References Cited

U.S. PATENT DOCUMENTS

| | | | |
|---|---|---|---|
| 1,925,625 | 9/1933 | Budd et al. | 17/11 |
| 2,470,151 | 5/1949 | Digby | 17/11.1 |
| 2,592,484 | 4/1952 | Smith | 128/354 |
| 4,079,741 | 3/1978 | Daar et al. | 128/355 |
| 4,359,853 | 11/1982 | Simpson, Jr. | 56/35 |
| 4,575,902 | 3/1986 | Alazet | 19/2 |
| 4,960,422 | 10/1990 | Demeester | 606/135 |
| 5,032,126 | 7/1991 | Cleyet et al. | 606/133 |
| 5,041,123 | 8/1991 | Oliveau et al. | 606/133 |
| 5,057,116 | 10/1991 | Zucker | 606/133 |
| 5,078,715 | 1/1992 | Daar et al. | 606/43 |
| 5,084,055 | 1/1992 | Demeester | 606/133 |
| 5,100,413 | 3/1992 | Doley | 606/133 |
| 5,100,414 | 3/1992 | Doley | 606/133 |
| 5,171,315 | 12/1992 | Cabrero | 606/131 |
| 5,190,559 | 3/1993 | Gabion et al. | 606/133 |
| 5,196,021 | 3/1993 | Kabla | 606/133 |
| 5,197,969 | 3/1993 | Visscher et al. | 606/133 |
| 5,234,441 | 8/1993 | Heintke et al. | 606/133 |
| 5,234,442 | 8/1993 | Schäfer et al. | 606/133 |
| 5,254,124 | 10/1993 | Heintke et al. | 606/133 |
| 5,281,233 | 1/1994 | Dolev | 606/133 |
| 5,494,485 | 2/1996 | Gabion et al. | 606/133 |

FOREIGN PATENT DOCUMENTS

| | | | |
|---|---|---|---|
| 0 147 285 B1 | 7/1985 | European Pat. Off. | A45D 26/00 |
| 0 442 419 A2 | 8/1991 | European Pat. Off. | A45D 26/00 |
| 0 443 914 A1 | 8/1991 | European Pat. Off. | A45D 26/00 |
| 467 733 | 1/1992 | European Pat. Off. | A45D 26/00 |
| 0 513 900 B1 | 11/1995 | European Pat. Off. | A45D 26/00 |
| 902158 | 8/1945 | France | A45D 26/00 |
| 999043 | 1/1952 | France | A45D 26/00 |
| 43 09 406 C2 | 6/1995 | Germany | A45D 26/00 |
| 44 27 788 A1 | 2/1996 | Germany | A45D 26/00 |
| 7-313243 | 12/1995 | Japan | A45D 26/00 |
| 404399 | 1/1934 | United Kingdom . | |

*Primary Examiner*—Willis Little
*Attorney, Agent, or Firm*—Edward S. Podszus

[57] ABSTRACT

The invention is directed to a rotary cylinder (7) for an epilating appliance comprising several pairs of clamping members (8) arranged in an angularly offset relation to each other, and actuating members (22) serving to move the clamping members (8) in pairs into, and subsequently out of, relative clamping engagement in the area of a plucking zone of the epilating appliance. Further, at least one control member is provided for controlling the actuating members (22). According to the invention, each pair of clamping members (8) has associated to it a separate, individually movable actuating member (22).

91 Claims, 8 Drawing Sheets

1
8
7
3
6
5
2
4

ROTARY CYLINDER FOR AN EPILATING APPLIANCE

This invention relates to a rotary cylinder for an epilating appliance as well as to the epilating appliance itself. The cylinder is comprised of several pairs of clamping members arranged in a substantially angularly offset relation to each other, and of actuating members serving to move the clamping members in pairs into, and subsequently out of, relative clamping engagement in the area of a plucking zone of the epilating appliance. Further, at least one control member is provided for controlling the actuating members.

Rotary cylinders for epilating appliances and epilating appliances per se are well known in the art. Typically, they include several pairs of clamping members which are conventionally arranged parallel to each other in a side-by-side relationship and in several rows parallel to the axis of rotation of the rotary cylinder, so that all the clamping members of a row traverse a plucking zone at the same time. The clamping members of a row are usually actuated jointly, thus forming a linear plucking area on the user's skin.

In an alternative embodiment of a rotary cylinder, the clamping members are arranged in the rotary cylinder in such manner that, as seen looking at a developed plan view of the cylinder shell surface, the pairs of clamping members are arranged in an angularly offset relation to each other. In contrast to the above-described linear plucking action, a punctiform plucking action is created on the user's skin. A rotary cylinder of this type is known, for example, from JP H 7-313243. This cylinder is essentially comprised of rod-type clamping members which are arranged on the cylindrical shell surface of a roll and are radially slotted. The slot of a clamping member is disposed in axially offset relation to the slot of an adjacent clamping member.

An epilating appliance, in particular a rotary cylinder for an epilating appliance is known from U.S. Pat. No. 5,196,021. This patent discloses a plurality of disk-like elements having radially outwardly extending leg-type clamping elements provided with clamping surfaces. The clamping surfaces of two adjacent disks combine to form a plurality of pairs of clamping elements. Provided on the rear side of a clamping element remote from the respective clamping surface are projections for actuation of the clamping elements, which projections are integrally formed with the clamping elements, and particularly the disks are made of injection-molded plastic material, and the projections are at least partially of different lengths. During rotation of the stack of disks, the projections related to a pair of clamping elements are caused to travel past end cam elements, so that in a plucking zone of the appliance a respective pair of clamping elements performs an approaching movement by being actuated at either end, thus effecting a clamping action. As this occurs, the radially outer ends of the clamping elements which carry the clamping surfaces are bent towards each other, returning to their initial spaced-apart position upon leaving the cam elements. The clamping elements of all the disks forming the rotary cylinder are in such relative arrangement that a single pair of clamping elements at a time is in a plucking zone of the epilating appliance, while the clamping elements of a closed pair, as seen looking in the circumferential direction of the cylinder, overlap partially with the respective adjacent open clamping elements.

In these known appliances, it has shown that the efficiency of the epilating operation often fails to satisfy the user, meaning that it would be desirable for the user to pluck several hairs per unit of time, thus speeding up the process of epilation. Also, it is desirable to reduce the pain felt during epilation still further in order to enable the user to perform a more efficient and low-pain epilating operation.

It is, therefore, an object of the present invention to avoid the disadvantages referred to in the foregoing and to provide a rotary cylinder for an epilating appliance or an epilating appliance itself which, on the one hand, removes hair more efficiently and, on the other hand, causes less pain to its user.

SUMMARY OF THE INVENTION

This object is accomplished in a rotary cylinder for an epilating appliance in that each pair of clamping members has associated to it a separate, individually movable actuating member. This results in a rotary cylinder which includes several pairs of clamping members arranged in a substantially angularly offset relation to each other, in addition to enabling a separate actuation of these clamping members. The advantages thereby afforded are an independent control of individual pairs of clamping members, and a defined introduction of the force acting on each single pair of clamping members. Also, a defined gripping of one or several hairs entered between the clamping members is thereby accomplished; the hair or hairs are thus securely caught and plucked with greater efficiency. Further, the physical separation of the actuating member from other components and the separate construction prevent the undesired effect of the clamping members tilting from a plane out of the circumferential direction. Still further, by associating one individually movable actuating member to a pair of clamping members, a one-side control of the clamping members is advantageously proposed, that is, the one actuating member is associated to only one clamping member of a pair of clamping members, actuation being usually effected from the end of the rotary cylinder.

Moreover, the separate construction of actuating member and clamping members advantageously enables the actuating member to be positioned such as to produce an optimum closing action of the clamping members, that is, a parallel closing action of the clamping members of a pair. An undesired tilting, jamming or similar movement can thus be precluded advantageously. A uniform clamping force is produced between a pair of clamping members, involving little pain as hair is being pulled.

In a further feature of the present invention, it is proposed arranging the actuating members slidably parallel to the axis of rotation of the rotary cylinder between each pair of clamping members and the corresponding control member. Advantageously, this enables a direct transmission of force from the control member via the actuating member to a clamping member, proposing a simple, direct and low-friction arrangement of the actuating member in the rotary cylinder.

In a particular feature of the present invention, two or more pairs of clamping members are arranged on the rotary cylinder in a line in an axially offset relationship to each other, thus traversing a plucking zone of the epilating appliance simultaneously. On the one hand, the substantially angularly off-set arrangement of different pairs of clamping members thus reduces the number of clamping members in a line on the rotary cylinder, involving the advantageous effect of a less pain provoking epilation by reason of the greater relative distance of the individual clamping members. On the other hand, the arrangement of two or more pairs in a line on the rotary cylinder enhances the efficiency of the plucking action still further, if so desired or required. Advantageously, control of the two or more pairs of clamping members in a line is from the two ends of the rotary cylinder.

In another feature of the present invention, a pair of clamping members is comprised of one stationary and one movable, in particular pivotal, clamping member. In this feature, the movable clamping member is arranged closer to an outer end of the rotary cylinder than the stationary clamping member. Thus a minimum possible number of movable components is necessary, whereby a minimum possible body mass is moved. Advantageously, a reduced force for driving the rotary cylinder and a reduced noise are thereby proposed. Because the movable clamping member is disposed closer to the outer end of the rotary cylinder than the stationary clamping member, the shortest relative distance of the pivotal clamping member to the control member is provided, the control member being usually disposed at the end of the rotary cylinder.

In a particular further feature, the actuating member is adapted to be urged against the surface of the movable clamping member on the side close to the control member. This has the advantage of accomplishing a short and direct force introduction between the control member and the one movable clamping member of a pair of clamping members.

In a still further feature of the rotary cylinder, provision is made for two clamping members to form one clamping blade, and for in particular two stationary clamping members to form one integrally formed, stationary clamping blade, and for two movable clamping members to form one integrally formed, movable clamping blade. A further advantageous reduction of the number of components is thereby proposed, because two pairs of clamping members, that is, four individual clamping members, combine to form two clamping blades.

Particularly advantageously, the clamping blades are configured and arranged such as to extend through the rotary cylinder diametrically. In this arrangement, two clamping blades disposed in pairs form each two pairs of clamping members arranged at diametrically opposite locations on the rotary cylinder.

In a further feature of the present invention, the control member is configured as a control disk which includes a control cam, in particular an inclined plane, and has its end arranged so as to face the rotary cylinder in the housing of the epilating appliance or the appliance head. A different construction of the control cam thus affords the advantage of enabling the movement of the actuating members to be varied, so that, for example, the provision of a flat or a steep ramp in the control cam enables a slow or an abrupt actuation of the clamping members to be adjusted. The ramp of the control cam may be of a continuous or a stepped configuration.

Still further, it is proposed mounting a pressure roller in the control disk so as to be rotatable therein. This results in a significant reduction of the friction between the actuating member and the control disk or pressure roller in that area in which the actuating member travels over the pressure roller.

In a particular embodiment of the rotary cylinder, the pressure roller protrudes a small amount from the plane of the control cam, in particular from the inclined plane, in the direction of the actuating member. In this embodiment, the pressure roller is advantageously provided at that location on the control cam where the clamping members are in their clamping position. As a result, the actuating member can be initially actuated continuously via the control cam of the control member, that is, approaching and receding from the clamping member; the clamping members are now in relative clamping engagement. The pressure roller then advantageously transmits the pressure force for exerting the clamping force of the clamping members, the rotary pressure roller operating accordingly to exert a defined, low-friction force on the clamping member via the actuating member.

In an advantageous feature, the actuating member is configured as a pin-type pressure element, in particular as a cylindrical pressure pin or control stud. A simple form of pressure element is thus proposed, with the advantage of affording economy of manufacture in large quantities using metal or plastic, and of enabling the requisite tolerance dimensions, in particular length tolerances, to be maintained with ease.

In another feature of the present invention, the pressure pin is axially slidably guided in a bore of the rotary cylinder, the bore extending essentially parallel to the axis of rotation of the rotary cylinder. This results in a simple guide for the pressure pin, providing a direct transmission of the clamping force from the control disk via the pressure pin to the clamping member. Advantageously, the tolerances of the pressure pin diameter and of the bore diameter can be coordinated in a simple manner. Further, the arrangement of the bore essentially parallel to the axis of rotation of the rotary cylinder affords simple and low-cost manufacture of the bore and consequently of the guide for the pressure pin.

Advantageously, the bores for all the pressure pins of a rotary cylinder are arranged on a common pitch circle so that they can be manufactured with ease and also can be spaced symmetrically.

In a further feature of the present invention, the pressure pins associated to two corresponding, diametrically arranged pairs of clamping members, in particular one pair of clamping blades, are of like or approximately like length. This affords the advantage of enabling the requisite number of different components to be reduced still further in cases where two pressure pins of like length are used for one pair of clamping blades. However, the possibility also exists for the clamping blades to be in an inclined position, in particular a slightly inclined position relative to a plane normal to the axis of rotation of the cylinder, so that the two pressure pins associated to this particular pair of clamping blades need to be of a slightly different length.

In a particular further feature of the rotary cylinder, the pin-type pressure elements have a hammerhead-type thickening at their outer ends on the side close to the respective control member. This proposes a simple manner of enlarging the end contact surface of the pressure elements pointing in the direction of the control member or the pressure roller. By this means, a flat, smooth control cam or a movement of the pressure pin towards the clamping member is proposed which has the advantage of resulting in reduced wear and noise.

In another feature of the rotary cylinder, the pressure pins, in particular the control studs, are relatively spaced in order for the ends of the hammerhead-type thickenings of all pressure pins on the side close to the control member to form a nearly closed circular-ring-shaped area. This advantageously avoids the occurrence of spaces between the individual pressure pins—as seen looking from the end of the rotary cylinder—which would cause a jerky sudden control action of the pressure pins and thus an abrupt actuation of the clamping members if the pressure roller entered such spaces. Rather, it is proposed providing a minimum possible space between the individual hammerhead-type thickenings, resulting in a nearly continuous transition from one pressure pin to the succeeding pressure pin on the control member. The substantially closed circular-ring-shaped end surface formed by the thickenings of all control studs thus travels advantageously in a nearly continuous movement over the control member, in particular the pressure roller in the control member.

In another feature of the present invention, it is proposed that the movable clamping members, in particular the clamping blades extending diametrically through the rotary cylinder, have a defined pivot axis. This is advantageous to enable a defined movement of the clamping members and thus a secure clamping and plucking of the hair. This has also a beneficial effect on pain reduction during the epilating operation.

Still further, it is proposed that the pivot axes of the clamping blades intersect the axis of rotation of the rotary cylinder, which has the advantageous effect of enabling a substantially symmetrical configuration of the clamping blades and the rotary cylinder.

In a further feature of the rotary cylinder, the clamping blades are of a strip-shaped configuration. This has the advantage of affording ease of manufacture of the clamping blades, which are thus particularly suited for quantity production.

In a further feature, the clamping blades are provided with pivot bearings which are preferably configured as two protuberances or noses extending from the longitudinal sides of the clamping blade essentially in mirror symmetry to the longitudinal axis of the clamping blade. Moreover, the pivot bearings are arranged such as to divide the clamping blade into two clamping members. The two clamping members extending outwardly from the pivot bearing are of slightly different radial lengths. With a possible inclined position of the clamping blades in the rotary cylinder, it is thus possible advantageously to accomplish a uniform engagement of the movable clamping blade with a corresponding stationary clamping blade.

A further proposal includes manufacturing the clamping members, in particular the clamping blades, as stamped sheet metal parts. This enables a particularly low-cost manufacture of the clamping blades in large quantities.

In a particularly advantageous further feature of the present invention which may also be an independent invention, the rotary cylinder is comprised of several disk-type components, in particular circular cylindrical disks. These disks are in an essentially parallel side-by-side arrangement adjoining each other directly, without a substantial space or gap existing between two adjacent disks. With this modular construction of the rotary cylinder—one disk being referred to as a module—a simple and low-cost manufacture of the rotary cylinder is proposed advantageously. Further, the possibility exists to assemble a rotary cylinder from nearly any desired number of such modular disks in order to thus vary the size, in particular the length of a rotary cylinder. On the other hand, a variation of the rotary cylinder is also accomplishable by a combination of various types of modular disks.

In a further feature of the rotary cylinder, it is proposed providing a disk with at least one recess for receiving a clamping member, in particular a clamping blade. Such a recess for a clamping blade can be manufactured advantageously with ease, its size and position relative to the disk being variable.

In a further feature of the disk, it includes a groove-type recess on its front and/or rear side, in particular a groove of rectangular cross-section for receiving a clamping blade. These grooves extend in particular diametrically relative to the front or rear side of the circular cylindrical disk. By providing the disk with a groove on its front and/or rear side, it is possible to arrange several disks of like type in a directly adjoining relationship, whereby one clamping blade on the front side of a first disk combines with a further clamping blade on the rear side of a second disk to form a pair. This affords the advantage of enabling ease of multiplication of pairs of clamping blades.

In a particular feature of the groove, it is of a sloping configuration relative to the front and/or rear side of the disk and is thus provided in particular for receiving a clamping member or a clamping blade which is stationary, that is, immovable relative to the disk. As a result, the two radially outer ends of the clamping blade are in an axially offset orientation relative to the axis of rotation of the rotary cylinder. The advantage afforded by this arrangement is that one pair of clamping blades, that is, four clamping members, are suited to provide two axially offset plucking paths. Enhancing the homogeneity of the plucking events, these offset plucking paths effect a thorough and efficient hair plucking operation. As a result, with an arrangement of one pair of blades, that is, four clamping members in a rotary cylinder, as many as two plucking paths can be obtained. With an arrangement of two pairs of clamping blades in the rotary cylinder, four plucking paths are generated. The sloping arrangement of the grooves of a disk and thus also of the clamping blades has the advantage of enabling a thorough plucking action to be performed.

In another further feature of the disk, it includes a groove on both its front and rear side, with the longitudinal axes of these grooves being offset relative to each other about the axis of rotation of the disk. Accordingly, the blade pair on the front side of the disk is in offset relation to the blade pair on the rear side of the disk. By reason of this relatively offset arrangement of the two adjacent blade pairs, the clamping members traverse the plucking zone of the epilating appliance with a time lag. As a result, a separation of individual plucking events with regard to place and time is accomplished in a simple manner, with a beneficial effect on the reduction of pain.

In an alternative feature of the grooves in the disks of a rotary cylinder, these grooves are towards either end of a sloping configuration relative to the front and/or rear side of a disk, so that the groove depth increases from the center of the disk to the respective outer peripheral areas of the disk. These grooves are intended to receive the pivotal clamping members, in particular the pivotal clamping blades. Advantageously, the clamping blades may be pivotally mounted about an area close to the disk center, thus performing a closing and opening movement of the clamping blades of a pair in the outer peripheral areas of the disk.

In a particular configuration of the disk of the rotary cylinder, the disk includes recesses on its front and/or rear side for receiving the pivot bearings of a pivotal clamping blade. These recesses are connected in particular with the groove sloping towards either end and are arranged substantially in the center of the disk, with the attendant advantage of enabling a pivotal clamping blade to be simply placed into these recesses and be carried therein securely. By providing a groove with the recesses for receiving therein a pivotal clamping blade, it distinguishes easily from a groove intended to receive a stationary clamping blade when a rotary cylinder is being assembled.

According to a further proposal, each groove of a disk receives therein one clamping blade, in particular one stationary and one pivotal clamping blade. This identical configuration of the modular disks affords the advantage of enabling the pairs of clamping blades to be multiplied with ease. As required, different numbers of modular disks may be arranged adjacent to each other in like direction, thus forming a rotary cylinder of nearly any desired length.

In a particularly advantageous further feature of the rotary cylinder, two different types of disks, in particular center and outer disks, are provided. Advantageously, this is a simple way of proposing a further variation possibility for the rotary cylinder with different types of disks.

Advantageously, a center disk is configured such as to have on its front and rear side each a groove sloping towards one end, as described in the foregoing. Such a center disk is therefore advantageously suitable for receiving two stationary clamping blades placed each into a groove on the disk front and rear side.

By contrast, an outer disk is configured such as to have on its front side a groove sloping towards either end, and on its rear side a groove sloping towards one end only. As a result, in particular a pivotal clamping blade can be mounted on the front side, and a stationary clamping blade can be mounted on the rear side. The front side of such a modular outer disk with its pivotal clamping blade can thus be combined with the front or the rear side of a center disk described in the foregoing. Advantageously, the rear side of the outer disk carrying a stationary clamping blade may be adjoined by the front side of another outer disk carrying a pivotal clamping blade.

In a particular further feature of the rotary cylinder, a plurality of outer disks of like type are arranged on either side of a center disk. Owing to the modular construction of the disks and the special arrangement, a simple multiplication of disks and a variation possibility of the rotary cylinder are thus proposed advantageously.

In another further feature, all outer disks are arranged adjacent to each other in like direction on either side of a center disk, and particularly the sides of the disks provided with the grooves sloping towards either end are arranged outwardly, facing the ends of the cylinder. Advantageously, therefore, also the pivotal clamping blades are provided on the outsides facing the ends of the rotary cylinder and are thus easily and directly movable by actuating members acting from the end of the rotary cylinder.

The disks of the rotary cylinder can be manufactured in large quantities particularly advantageously and economically if the center and outer disks are made of plastic.

In a further feature of the present invention which may also be an independent invention, at least one engaging groove serving in particular for the guided entry of the user's hair to be epilated is provided in the shell surface of the rotary cylinder. This advantageously proposes a simple guiding of the hair to epilated in the direction of the respective pairs of clamping members, and an engagement of the hair between these pairs of clamping members.

In a particular configuration of the engaging groove, it is arranged in the manner of a helical line. As a result, all areas of the skin surface to be epilated are swept by an engaging groove, so that advantageously all hairs are caught by the engaging groove and directed to a pair of clamping members.

Still further, it is proposed that the engaging groove extend from a first pair of clamping members to a second pair of clamping members traversing the plucking zone after the first pair and being angularly offset relative to the first pair. Thus, one or more hairs, which the first pair of clamping members has failed to catch and pluck, are fed through the engaging groove to a second pair of clamping members. This enhances the efficiency of the rotary cylinder advantageously.

In an alternative embodiment, the engaging groove includes a branch leading from a first pair of clamping members to a second or a third pair of clamping members. In this embodiment, the second and third pairs each are arranged in different directions axially and are angularly offset relative to the first pair. Thus, depending on position and direction of growth, one or more hairs, which a first pair of clamping members has failed to catch, have the chance of being fed to a second or a third pair of clamping members for plucking.

A further proposal involves arranging several engaging grooves in a parallel side-by-side relationship to each other on the rotary cylinder. This results in the advantage that nearly any hair to be plucked on the skin surface enters one of the engaging grooves and thus can be fed to a pair of clamping members.

In another configuration of the present invention, two pairs of clamping members associated to one pair of clamping blades and arranged substantially diametrically opposite each other in the rotary cylinder are associated to two different, in particular relatively offset engaging grooves. This affords the advantage of enabling two different engaging grooves to be moved over nearly one and the same area of the skin surface to be plucked, thus feeding the hair to be caught to a pair of clamping members for plucking.

In a further feature of the present invention, it is proposed providing the rotary cylinder with a substantially closed, smooth shell surface. This closed shell surface has the advantageous effect of acting as a skin hold-down means surrounding the clamping members, with the hair to be epilated being fed to the clamping members through the engaging grooves provided in the rotary cylinder.

A particular further feature of the present invention proposes that an epilating appliance be adapted to be combined and operated in conjunction with a rotary cylinder embodying the features described in the foregoing. Thus, a rotary cylinder constructed in accordance with the invention can be mounted on an epilating appliance and used for epilation in cooperation with the appliance.

In a particular further feature of an epilating appliance, it is operable at different speeds for driving different attachments as, for example, a rotary cylinder embodying the foregoing features. Because the rotary cylinder of the present invention requires a specified drive speed, this speed is advantageously made available by the epilating appliance. When another attachment operated at a different speed is substituted for the rotary cylinder, this particular speed is adjustable on the epilating appliance, being accordingly variable.

Another advantageous embodiment of the epilating appliance provides for the epilating appliance to include a rotary cylinder embodying the features described in the foregoing, that is, for the rotary cylinder to be integrally connected with the epilating appliance.

Still further, it is proposed that the epilating appliance include a rotary cylinder having on at least one end thereof a control disk with a control cam for driving the actuating members, and a pressure plate with a control cam, in particular an inclined plane, for adjusting the clamping force of the clamping members. This has the advantage of enabling the user to perform an adjustment of the clamping force of the cylinder of the invention using simple means.

Further features, advantages and application possibilities of the present invention will become apparent from the subsequent description of embodiments illustrated in more detail in the accompanying drawings. It will be understood that any single feature and any combination of single features described and/or represented by illustration form the subject-matter of the present invention, irrespective of their summary in the claims and their back-reference.

DETAILED DESCRIPTION OF THE INVENTION

Figure 1:
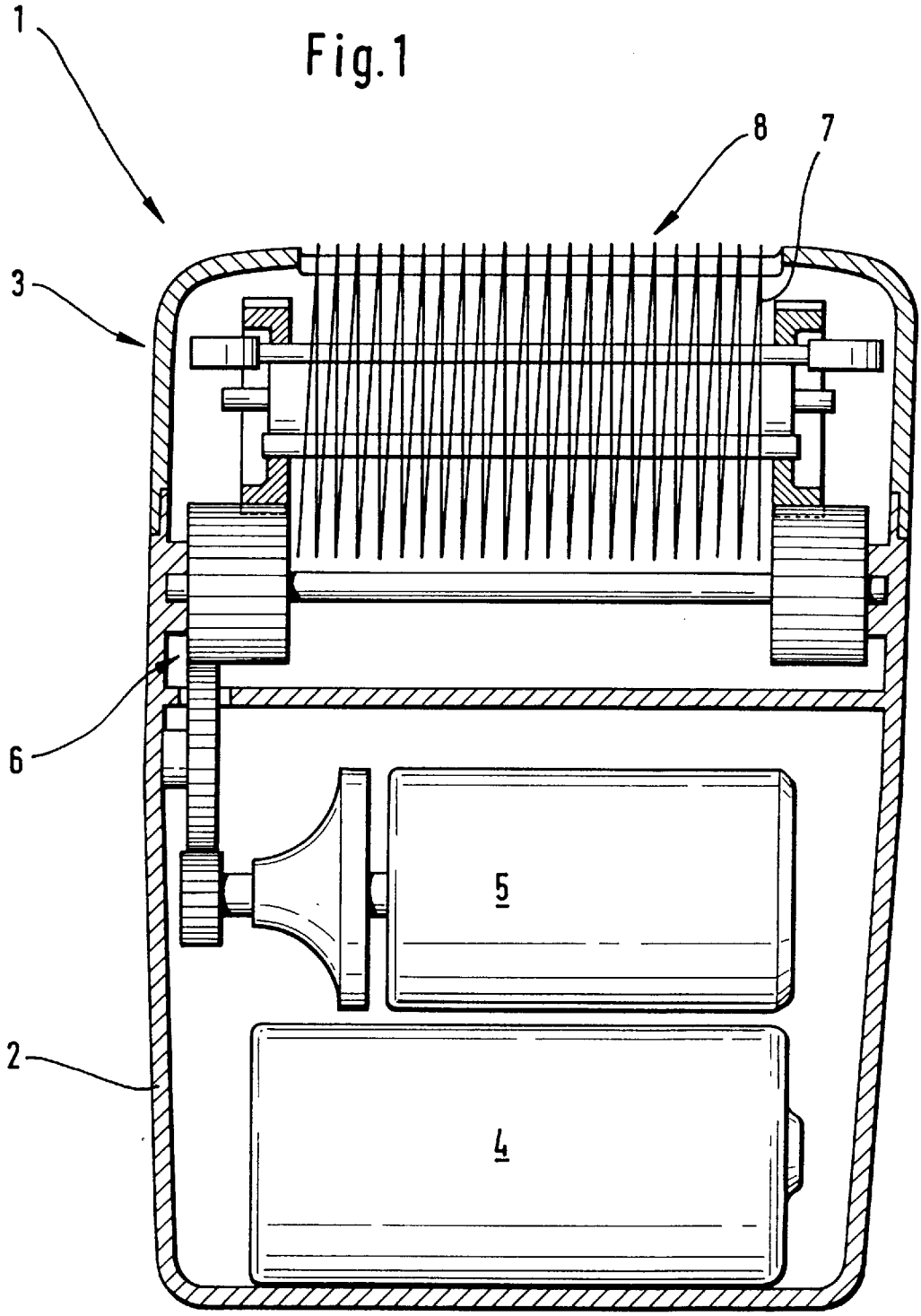
FIG. 1 is a schematic sectional view of an epilating appliance showing the functional components.

An epilating appliance (FIG. 1) functionally comprises a housing 2 and an appliance head 3 connected therewith. The housing 2 accommodates a storage battery 4 and a motor 5, with the motor 5 being adapted to be connected with a rotary cylinder 7 arranged in the appliance head 3 by means of a transmission mechanism 6. The cylinder 7 in turn is substantially comprised of a plurality of clamping members 8 in side-by-side arrangement.

The rotary cylinder 7 (FIG. 2) is formed of a plurality of parallel disks arranged side-by-side, including one center disk 10 and a plurality of outer disks 11 disposed on either side of the center disk 10. Clamping members 8 are arranged in the disks 10, 11. A respective end disk 12, 13 is provided at either end of the disk stack, with the left-hand end disk 13 having teeth for driving the rotary cylinder. The disk 13 meshes with a pinion 20 which in turn is driven by a motor not shown. The stack of disks 10, 11, 12, 13 forming the rotary cylinder 7 is mounted on a shaft 9 rotatably carried in a respective bushing in the appliance housing at either end of the rotary cylinder 7. Control members 14, 15 are fixedly secured in the housing of the epilating appliance. Both control members 14, 15 receive rotatably therein respective pressure rollers 16 arranged such as to protrude a small amount from the inner surface of the control members 14 and 15 on the side close to the rotary cylinder 7. This disk stack forming the rotary cylinder 7 and its two outer control members 14 and 15 are held together by a U-shaped spring 19 and compressed such as to ensure the clamping function of the individual clamping members 8. To adjust the compressive force of the U-shaped spring 19, a pressure plate 17 having an outer control cam 18 is arranged on the outside of the control member 14. By turning the pressure plate 17 about the axis of the shaft 9, the distance between the ends of the U-shaped spring and thus the clamping force exerted on the disk stack can be adjusted.

Figure 3:
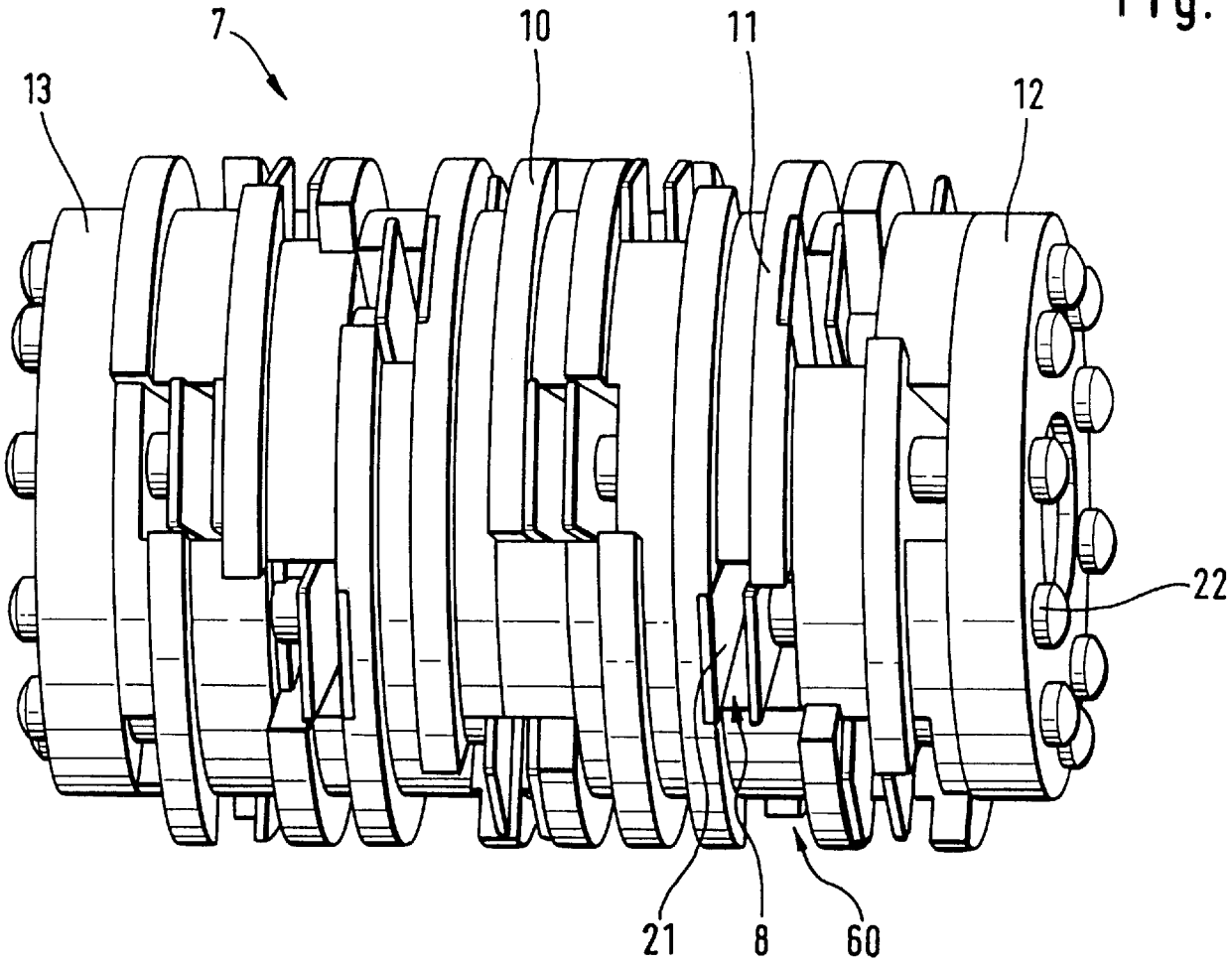
FIG. 3 is a schematic perspective view of the rotary cylinder of FIG. 2, but without the control members and pressure plates at the cylinder ends.

The clamping members 8 (FIG. 3) are arranged in recesses 21 provided in a groove 60 on the shell surface of the rotary cylinder 7. The end disks 12 and 13 provided at the respective ends of the disk stack retain therein pressure pins 22 in substantially parallel alignment to the axis of rotation of the rotary cylinder 7. The pressure pins 22 are received in bores on a common pitch circle, projecting all in unloaded condition from the outer ends of the end disks 12 and 13 by about the same amount. The other ends of the pressure pins 22 are in the interior of the rotary cylinder 7, abutting each a clamping blade of each pair of clamping blades. In this arrangement, all of the clamping blades in the right-hand half of the rotary cylinder 7 are actuated by pressure pins 22 guided in the right-hand end disk 12. The clamping members located in the left-hand half of the rotary cylinder 7 are actuated by pressure pins guided in the left-hand end disk 13.

Figures 4, 5:
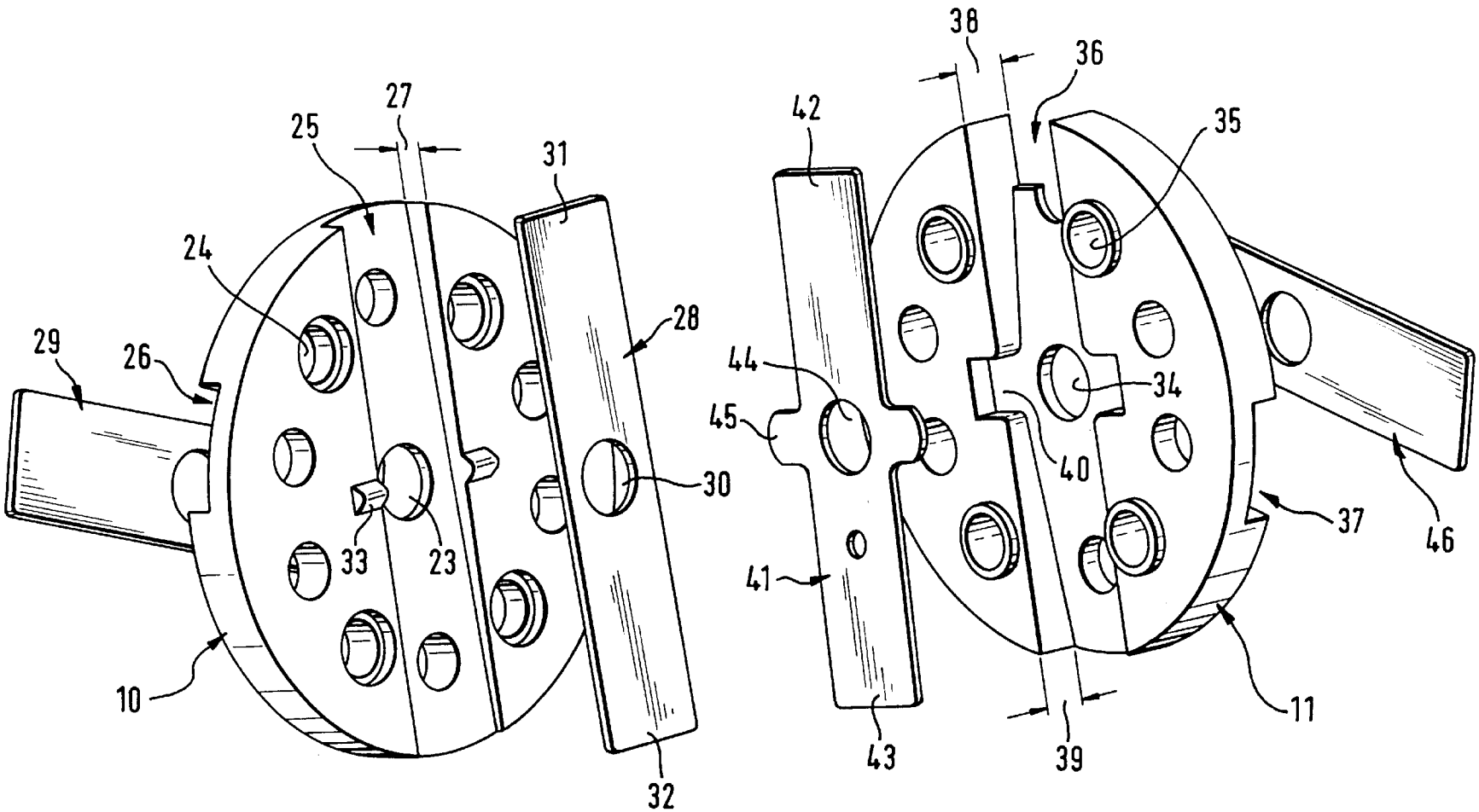
FIG. 4 is a schematic perspective view of a center disk of FIG. 2 showing the related clamping members.
FIG. 5 is a schematic perspective view of an outer disk of FIG. 2 showing the related clamping members.

A center disk 10 (FIG. 4) includes a center bore 23 for receiving the cylinder shaft. Arranged concentrically with the bore 23 on a pitch circle are a plurality of bores 24 intended to guide the pressure pins. On the front side of the disk 10 is a groove 25 extending at an inclination relative to the upper surface of the front side and being at its upper end of a depth 27 greater than the groove depth at the opposite end of the groove 25. On the rear side of the disk 10 is a corresponding groove 26 which is equally inclined relative to the upper surface of the rear side. The groove 25 receives a stationary strip-shaped clamping blade 28, while the opposite groove 26 receives a corresponding clamping blade 29. The blade 28 is provided with a bore 30 for passage of the cylinder shaft. The upper and lower ends of the blade 28 form the clamping surfaces 31 and 32 which cooperate with a corresponding clamping blade of an adjacent disk. Immediately adjacent to the bore 23, supports 33 are provided in the disk 10, which project from the surface of the disk front side.

An outer disk 11 (FIG. 5) is equally provided with a center bore 34 for passage of the cylinder shaft. Grooves 36 and 37 are provided on opposite sides of the disk 11 and are offset relative to each other about the axis of rotation of the disk 11. The disk 11 further includes a plurality of bores 35 for guiding the pressure pins, said bores being in alignment with the bores 24 of the adjacent disk 10.

Starting from the center of the disk, the groove 36 is of a sloping configuration in the direction of either end thereof, causing the groove depths 38 and 39 at the diametrically opposite ends of the groove 36 to be greater than in the center of the disk 11. Corresponding recesses 40 are provided in this center, extending away from the longitudinal sides of the groove 36 at substantially right angles thereto.

A movable clamping blade 41 is provided with two diametrically opposed clamping surfaces 42 and 43. Provided roughly in the center of the clamping blade 41 is a bore 44 for passage of the cylinder shaft, and nose-shaped protuberances 45 extend from the longitudinal sides of the clamping blade 41. These noses 45 are placed into the recesses 40 of the groove 36 and are held in position by the supports 33 of the adjacent disk 10. On the opposite rear side of the disk 11, a stationary clamping blade 46 is received in the groove 37 inclined relative to the surface of the rear side of the disk 11.

Following assembly of the two disks 10 and 11, the clamping surfaces 31 and 32 of the stationary clamping blade 28 are opposite the clamping surfaces 42 and 43 of the clamping blade 41. A pivotal movement of the clamping blade 41 about the supports 33 causes the two clamping surfaces 42 and 43 to engage the two clamping surfaces 31 and 32 of the clamping blade 28.

Figure 6:
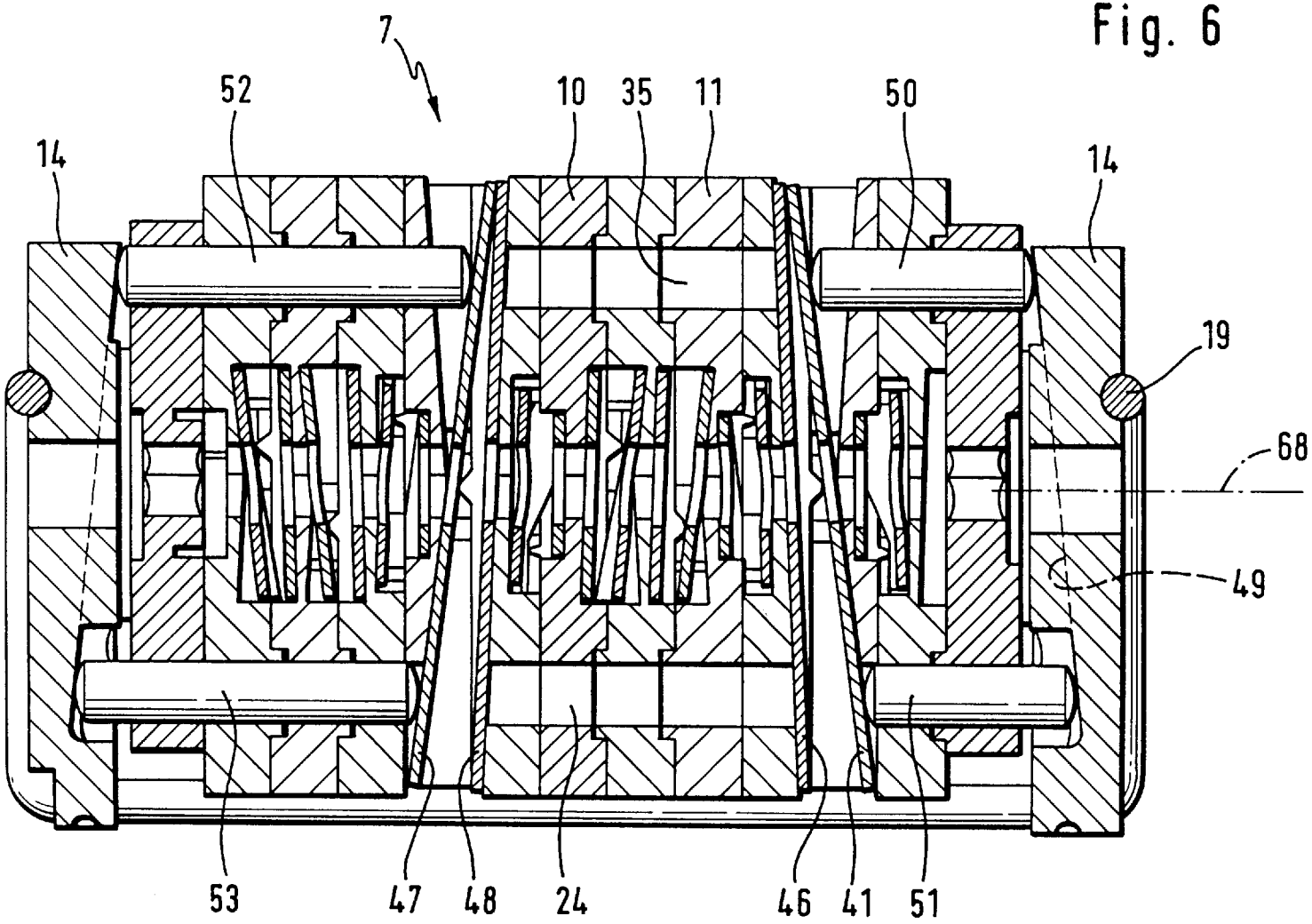
FIG. 6 is a schematic longitudinal sectional view of a rotary cylinder similar to the representation of FIG. 2.

The disks 10 and 11 (FIG. 6) are provided with bores 24 and 35 extending axially through the rotary cylinder and receiving therein the pressure pins 50 to 53. These pressure pins have their one ends, which are located in the interior of the cylinder, in abutment with the movable clamping blades 41 and 47. With their outer ends, the pressure pins 50 to 53 are in abutment with the control cams 49 of the control disks 14 fixedly located relative to the two ends of the rotary cylinder 7 in the housing of the epilating appliance. The two end control disks 14 are urged against each other by a U-shaped spring 19. On a rotation about the axis of rotation 68 of the cylinder 7, the pressure pins 50, 52 are moved from a lower unloaded position on the control cam 49 into an upper clamping position lying farther inwardly axially. The control cam 49 may extend in a continuous or also a stepped configuration. As soon as the pressure pins 50 and 52 have reached their upper clamping position, a force will be transmitted from the control disk 14 via the pressure pins 50 and 52 to the movable clamping members 41 and 47. This causes the pivotal clamping members 41, 47 to be urged into engagement with the stationary clamping members 46 and 48. The lower pressure pins 51 and 53 will recede axially outwardly into the recesses of the control cam 49, removing the load from the lower ends of the clamping blades 41 and 47, thus enabling them to pivot about the supports outwardly in the direction of the ends of the cylinder 7.

Figure 7:
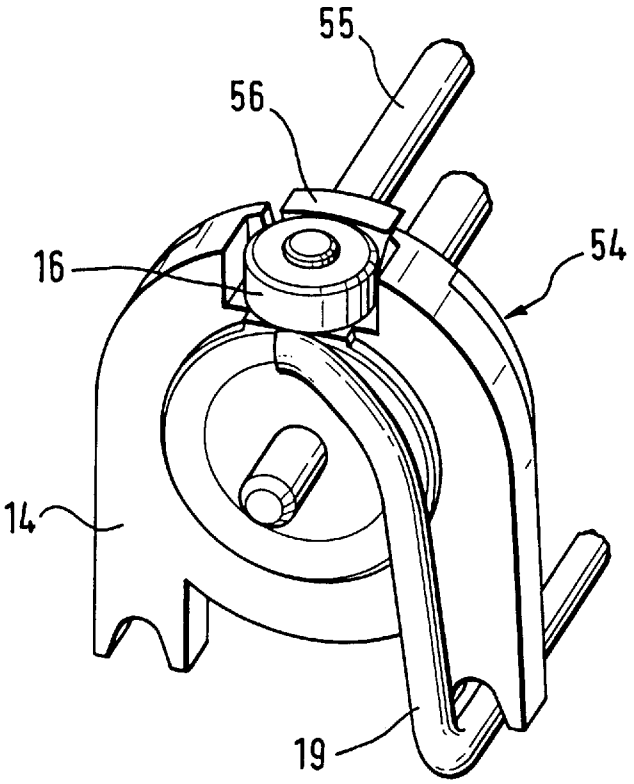
FIG. 7 is a partially broken away schematic view of the end of a rotary cylinder similar to the view X of FIG. 2.

A U-shaped spring 19 connects a control member 14 or control disk (FIG. 7) with another control member, not shown, at the opposite end of the rotary cylinder. The U-shaped spring 19 bears against the outside of the control disk 14. On the inside, that is on the side of the control disk 14 close to the rotary cylinder, a control cam 54, in particular an inclined plane, is provided which, starting from the upper edge of the control disk 14, slopes inwardly towards the rotary cylinder not shown. Further provided at the upper edge of the control disk 14 is a recess in which a pressure roller 16 is rotatably mounted. A control stud 55 supported in the rotary cylinder not shown travels along the control cam 54 as the cylinder rotates and is thus moved continuously in the direction of the rotary cylinder. Because the pressure roller 16 projects from the surface of the control cam 54 a slight amount, the control stud 55, on reaching the pressure roller 16, experiences a sudden axial movement in the direction of the rotary cylinder, that is, towards the clamping member arranged in the rotary cylinder. As an alternative to the cylindrical pressure pin shown thus far, the control stud 55 may have a hammerhead-type thickening 56 at its outer end. This makes it possible to move the control stud 55 and the clamping members in a manner reducing wear and noise.

Figure 2:
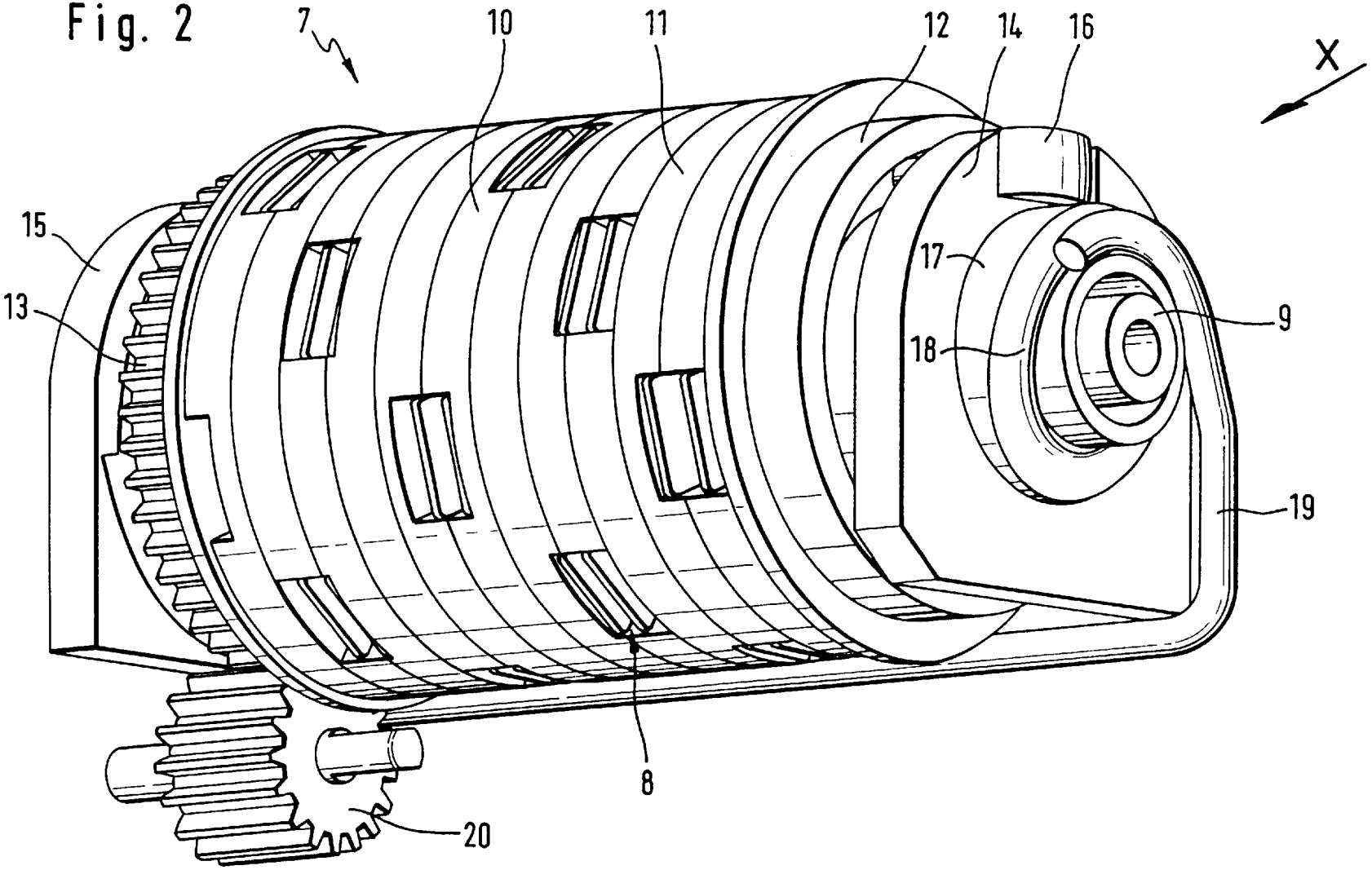
FIG. 2 is a perspective view/of a rotary cylinder unit of the invention, showing it in fully assembled condition with a U-shaped spring.
Figure 8:
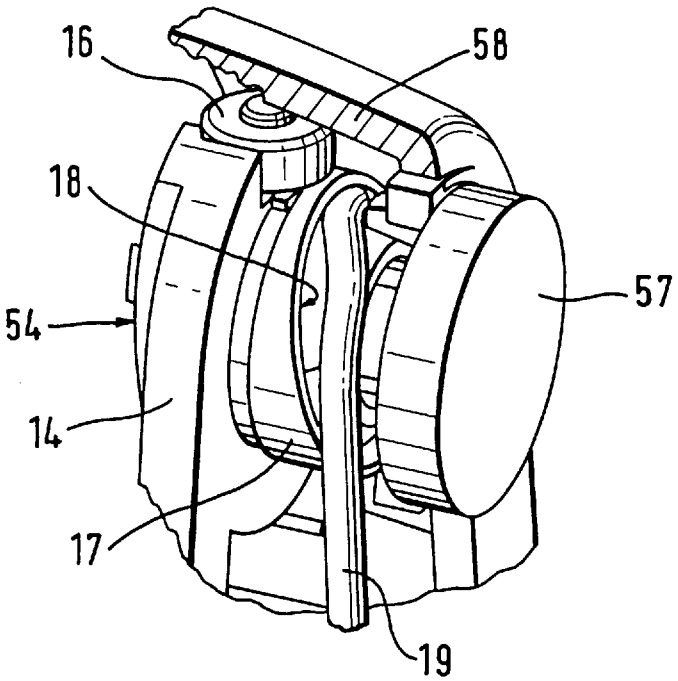
FIG. 8 is a view of an end of a rotary cylinder similar to the representation of FIG. 7, but showing an alternative embodying a pressure plate.

As shown in FIG. 2, there is also the alternative to provide a control disk 14 (FIG. 8) on its outer end with a pressure plate 17 which in turn includes a control cam 18. Turning a rotary button 57 causes an end of the U-shaped spring 19 to glide along the control cam 18, so that the distance between the two opposite ends of the U-shaped spring 19 is variable. This provides an easy way of adjusting the clamping force acting on the clamping members. With the exception of the rotary button 57 for adjusting the clamping force, all other components are arranged inwards of a housing wall 58 of the appliance head.

Figure 9:
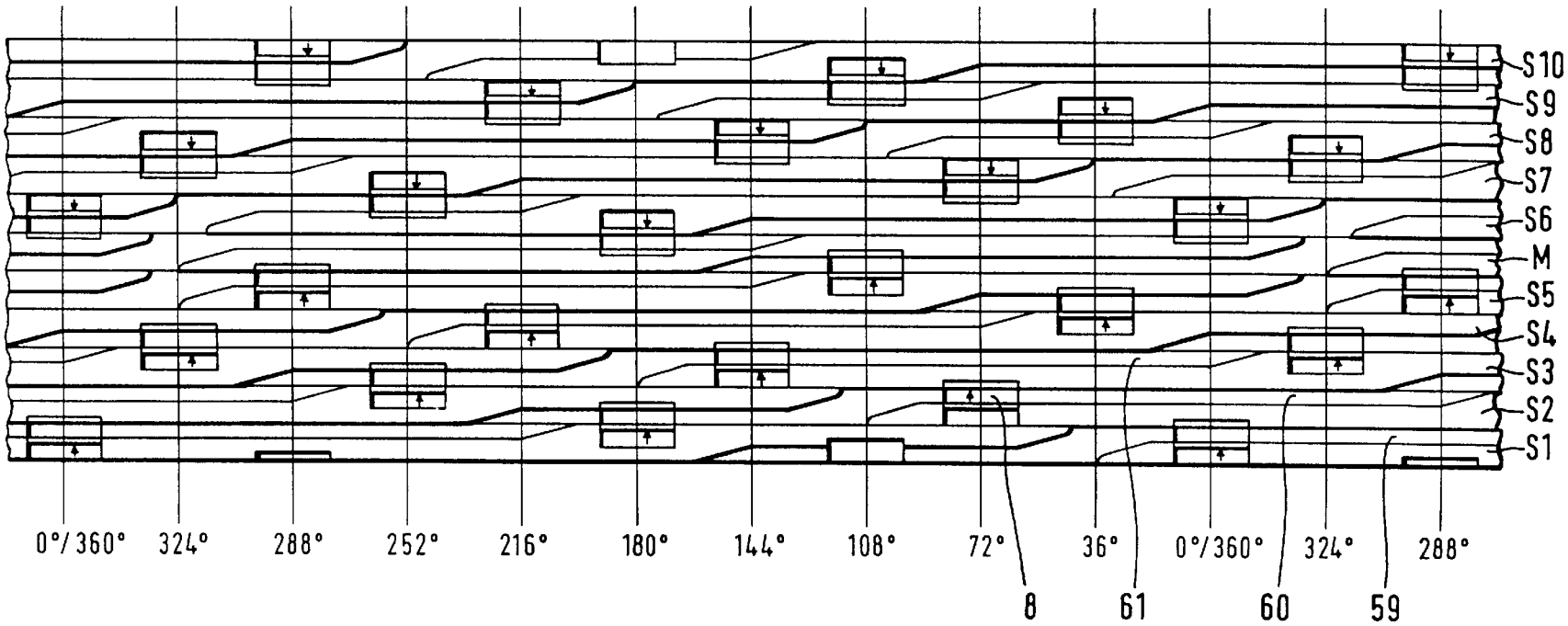
FIG. 9 is a schematic developed view of a shell surface of a rotary cylinder of the invention showing engaging grooves.

In a developed view of the shell surface of a rotary cylinder (FIG. 9), the disk numbers are indicated in the right-hand margin of the illustration; disks Nos. S1 to S5 and S6 to S10 are separated by a center disk M. In the lower margin, the angles at circumference are indicated from 0 to 360 degrees. In lines parallel to the axis of rotation of the rotary cylinder, each two pairs of clamping members 8 are arranged. As seen looking in the direction of rotation, the clamping members 8 are spaced 36 degrees apart, with the direction of rotation being opposite to the hair-engaging direction. Each of the outer disks Nos. S1, S2, S3 is provided with grooves 59, 60 and 61 extending in a screw thread-like line over the circumference of the cylinder shell. For example, groove 61 starts at 0 degrees in disk No. S3, opening at 288 degrees into groove 60 of disk No. S2. Groove 60 in turn opens after further 288 degrees, that is, at 216 degrees, into groove 59 of disk No. S1. As a result, all of the grooves provided on the shell surface are interconnected on a substantially helical line. The two clamping members of disk No. S1, which are at 0 and 180 degrees, are each disposed in different grooves 59, 60, so that hairs lying directly adjacent to each other on a skin surface to be epilated can be guided in two different grooves.

Figure 10:
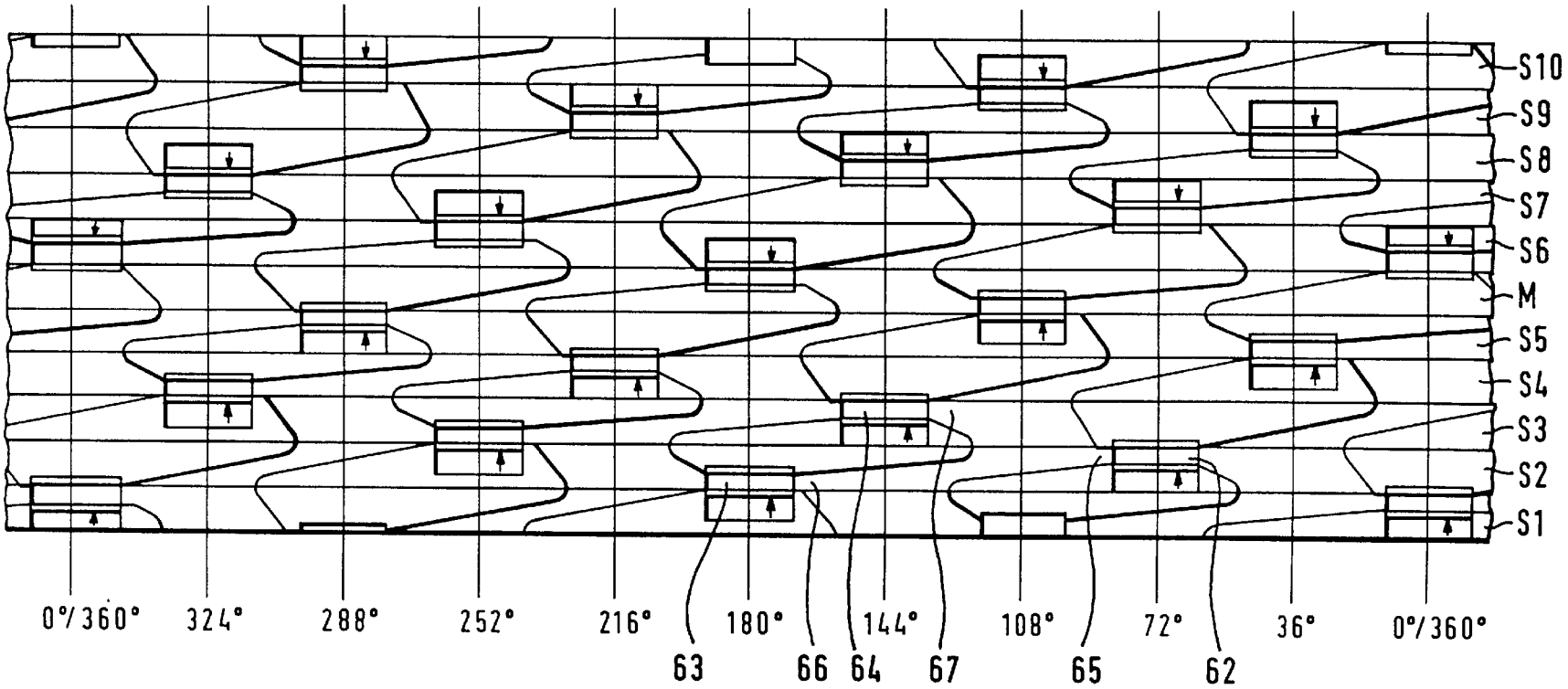
FIG. 10 is a developed view of a shell surface showing an alternative embodiment of the engaging grooves.

In an alternative embodiment of the groove guide (FIG. 10), a hair which, for example, could not be caught by the pair of clamping members 62, initially remains in groove 65; however, as this groove branches into a groove 66 and a groove 67, the uncaught hair can be subsequently fed to the pair of clamping members 63 in disk No. S2, or to the pair of clamping members 64 in disk No. S3.

A typical embodiment of a rotary cylinder of the present invention comprises one center disk and two times five outer disks arranged on either side of the center disk. In each disk two clamping blades are provided which extend through the rotary cylinder diametrically and carry at each of their outer ends a clamping member with a clamping width of 4 mm. Mounted in the cylinder are two times ten pressure pins located on a common pitch circle with an equidistant pitch of 36 degrees between every two adjacent pressure pins.

We claim:

1. A rotary cylinder for an epilating appliance, comprising a plurality of pairs of clamping members arranged on the cylinder circumference in a plurality of rows, the clamping members of each pair being relatively movable, and each row being angularly offset to other rows and each comprising at least one pair of clamping members, a plurality of actuating members serving to move the pairs of clamping members into, and subsequently out of, relative clamping engagement in a plucking zone along a shell surface of the rotary cylinder, and at least one control member driving the actuating members, and wherein each pair of clamping members is moved by a single one each of the plurality of actuating members into relative clamping engagement, each actuating member being formed separate from the clamping members and individually movable relative to others of the plurality of actuating members.

2. The rotary cylinder as claimed in claim 1, wherein the actuating members are slidably arranged parallel to the axis of rotation of the rotary cylinder between each pair of clamping members and the at least one control member.

3. The rotary cylinder as claimed in claim 1, wherein at least two pairs of clamping members are arranged on the rotary cylinder in at least one generally axially extending row in an axially offset relationship to each other, thus traversing the plucking zone simultaneously.

4. The rotary cylinder as claimed in claim 3, wherein each row of the plurality of rows has two pairs of clamping members.

5. The rotary cylinder of claim 1, wherein the actuating members are in non-rigid contact with the clamping members, thereby reducing an undesired skewing of the clamping members relative to the cylinder during actuation.

6. The rotary cylinder as claimed in claim 1, wherein each pair of clamping members comprises one stationary and one movable clamping member, wherein said movable clamping member is arranged closer to an outward end of the rotary cylinder having the associated control member than is the stationary clamping member.

7. The rotary cylinder of claim 6, wherein the movable clamping member is pivotal.

8. The rotary cylinder of claim 6, further comprising a plurality of stationary clamping blades and moving clamping blades each having two terminal regions, each said respective stationary and moving clamping blade having, disposed one at each said terminal region, respectively two said stationary and two said moving clamping members.

9. The rotary cylinder as claimed in claim 6, wherein the actuating member is urged against a surface of the movable clamping member facing the control member.

10. The rotary cylinder as claimed in claim 1, wherein each of a plurality of clamping blades comprises two said clamping members, said two clamping members associated to two axially non co-linear pairs of the clamping members, and said clamping blades each having the respective said two clamping members formed at respective first and second terminal regions of said clamping blade.

11. The rotary cylinder as claimed in claim 10, wherein the clamping blades extend through the rotary cylinder diametrically.

12. The rotary cylinder as claimed in claim 1, wherein the control member comprises a control disk at an axial end of the rotary cylinder and having a control cam surface facing the rotary cylinder.

13. The rotary cylinder as claimed in claim 12, wherein the control disk further comprises a pressure roller mounted in the control cam surface rotatable therein.

14. The rotary cylinder as claimed in claim 13, wherein the pressure roller protrudes from the control cam surface in the direction of the actuating members.

15. The rotary cylinder as claimed in claim 1, wherein the actuating members are formed as pressure pins.

16. The rotary cylinder as claimed in claim 15, wherein each pressure pin is axially slidably guided in a respective bore formed in the rotary cylinder, said bore extending substantially parallel to the axis of rotation of the rotary cylinder.

17. The rotary cylinder as claimed in claim 16, wherein the bores for the plurality of pressure pins are collectively arranged on a common pitch circle.

18. The rotary cylinder as claimed in claim 15, wherein the pressure pins associated to two diametrically opposite pairs of clamping members are of approximately similar length.

19. The rotary cylinder as claimed in claim 15, wherein the pressure pins have each a hammerhead-type thickened portion at their outer ends on the side close to the respective control member.

20. The rotary cylinder as claimed in claim 19, wherein the pressure pins are in spaced relation having their thickened portions extending towards adjacent pressure pins, the thickened portions collectively forming a ring facing the associated control member.

21. The rotary cylinder as claimed in claim 1, wherein at least one clamping member of each pair of clamping members pivots about a fulcrum.

22. The rotary cylinder as claimed in claim 1, wherein at least one clamping member of each pair of clamping members pivots about an axis intersecting the axis of rotation of the rotary cylinder.

23. The rotary cylinder as claimed in claim 10, wherein the clamping blades are strip-shaped.

24. The rotary cylinder as claimed in claim 10, wherein adjacent pairs of the clamping blades define at adjacent terminal regions said plurality of pairs of clamping members, and at least one clamping blade of each pair of clamping blades is movable, the movable clamping blade further comprising pivot bearings comprising two protuberances extending from respective longitudinal sides of the movable clamping blade opposite a longitudinal axis of the clamping blade, the pivot bearings being disposed at the juncture along the clamping blade of the two clamping members of that clamping blade.

25. The rotary cylinder as claimed in claim 24, wherein the juncture at which the pivot bearings are disposed is not equidistant between opposed ends of the clamping blade, whereby the two clamping members slightly differ in radially extending length.

26. The rotary cylinder as claimed in claim 1, wherein the clamping members comprise stamped sheet metal.

27. The rotary cylinder as claimed in claim 1, wherein the rotary cylinder comprises a plurality of substantially parallel adjacent cylindrical disks.

28. The rotary cylinder as claimed in claim 27, wherein each disk defines at least one recess in which is disposed a said clamping member.

29. The rotary cylinder as claimed in claim 10, wherein the rotary cylinder further comprises a plurality of substantially parallel adjacent disks each defining a generally diametrally extending groove formed in at least one of its front and rear faces, wherein the groove receives one said clamping blade having the two clamping members thereof disposed proximal opposed ends of the groove.

30. The rotary cylinder as claimed in claim 29, wherein in a first portion of the plurality of grooves each groove is inclined relative to a plane perpendicular to the rotational axis of the rotary cylinder, whereby pairs of diametrally opposite clamping members are axially offset along the rotational axis to thereby contact spatially separated regions of skin of a user as the clamping members traverse the plucking zone.

31. The rotary cylinder as claimed in claim 30, wherein clamping blades disposed in grooves of the first portion of the plurality of grooves are stationary.

32. The rotary cylinder as claimed in claim 27, wherein each disk defines a groove on each of its front and rear faces, said grooves having groove longitudinal axes offset relative to each other about the axis of rotation of the disk.

33. The rotary cylinder as claimed in claim 29, wherein in a second portion of the plurality of grooves each groove has a groove depth relative to the face in which the groove is formed that increases on opposite sides of the rotational axis from a center of the disk to respective peripheral areas of the disk.

34. The rotary cylinder as claimed in claim 33, wherein clamping blades disposed in grooves of the second portion of the plurality of grooves pivot.

35. The rotary cylinder as claimed in claim 29, wherein adjacent pairs of clamping blades define at adjacent terminal regions said plurality of pairs of clamping members, and at least one clamping blade of each pair of clamping blades is movable, the movable clamping blade further comprising pivot bearings comprising protuberances extending from respective longitudinal sides of the movable clamping blade opposite a longitudinal axis of the clamping blade, and the disk further defines recesses formed at a central region in the at least one face adjacent the groove and receiving the pivot bearings.

36. The rotary cylinder as claimed in claim 29, wherein the grooves formed in mutually facing faces of adjacent disks are in register with each other, receiving therebetween each said pair of relatively movable clamping blades.

37. The rotary cylinder as claimed in claim 29, wherein a first portion of the plurality of disks comprises at least one center disk defining grooves on each the disk front and rear faces, in which respective stationary clamping blades are disposed, and a second portion of the plurality of disks comprises at least one outer disk defining grooves on each the disk front and rear faces, in which respectively one movable and one stationary clamping blade are disposed.

38. The rotary cylinder as claimed in claim 37, wherein the at least one center disk has grooves on the front and rear faces each inclined with a groove depth, relative to the face in which the groove is formed, increasing from one groove end towards the opposed groove end.

39. The rotary cylinder as claimed in claim 37, wherein on the at least one outer disk the groove on the front face is inclined with a groove depth, relative to the face in which the groove is formed, increasing from a central region of the face to each of the opposed groove ends, and the groove on the rear face is inclined with a groove depth, relative to the face in which the groove is formed, increasing from one groove end towards the opposed groove end.

40. The rotary cylinder as claimed in claim 37, wherein the second portion of the plurality of disks comprises a plurality of outer disks arranged adjacent each of the front and rear faces of one center disk.

41. The rotary cylinder as claimed in claim 40, wherein each plurality of outer disks arranged adjacent each face of the center disk comprises disks arranged in a common orientation having respective front faces directed outwardly towards respective lateral ends of the rotary cylinder.

42. The rotary cylinder as claimed in claim 37, wherein the disks comprise plastic.

43. The rotary cylinder as claimed in claim 1, wherein the shell surface of the rotary cylinder further defines at least one hair engaging groove extending at least partially circumferentially and intersecting at least one pair of clamping members, whereby hair to be epilated guidedly enters the pair of clamping members during cylinder rotation.

44. The rotary cylinder as claimed in claim 43, wherein the at least one hair engaging groove extends helically around the rotary cylinder longitudinal axis.

45. The rotary cylinder as claimed in claim 43, wherein the hair engaging groove extends from a first pair of the plurality of pairs of clamping members to a second of the plurality of pairs of clamping members angularly offset relative to the first pair.

46. The rotary cylinder as claimed in claim 43, wherein the hair engaging groove intersects a first pair of clamping members and includes first and second branch grooves extending from the first pair of clamping members respectively to a second and a third pair of clamping members, wherein the second and third pairs of clamping members are disposed in axially opposite directions relative the first pair and angularly offset relative the first pair.

47. The rotary cylinder as claimed in claim 43, comprising a plurality of generally adjacent parallel hair engaging grooves.

48. The rotary cylinder as claimed in claim 43, wherein two diametrally opposite pairs of clamping members are intersected respectively by each of two hair engaging grooves, the hair engaging grooves being relatively axially offset.

49. The rotary cylinder as claimed in claim 43, wherein the shell surface defines a plurality of grooves and is substantially closed and smooth between the grooves.

50. The rotary cylinder as claimed in claim 1, in combination with the epilating appliance.

51. The rotary cylinder as claimed in claim 1, in removable combination with the epilating appliance, and wherein the epilating appliance is operable at at least two different speeds.

52. The rotary cylinder as claimed in claim 1, in permanent combination with the epilating appliance.

53. The epilating appliance as claimed in claim 12, further comprising a pressure plate having a pressure cam surface and mounted adjacent an outward end of the control disk, and a spring received on the pressure cam surface and urging the pressure plate against the control disk, the pressure cam surface being selectively movable relative the spring, whereby a clamping force applied by the actuating members driven by the control disk is adjustable.

54. The rotary cylinder as claimed in claim 1, wherein successive angularly adjacent pairs of clamping members are offset in an axial direction from each immediately preceding adjacent pair of clamping members, whereby a region of the skin being plucked varies in time during cylinder rotation.

55. A rotary cylinder for an epilating appliance for personal use, comprising a plurality of pairs of clamping members arranged on the cylinder circumference in a plurality of rows extending in a direction of the cylinder rotational axis, a plurality of actuators operating the pairs of clamping members into and subsequently out of relative gripping engagement in a plucking zone along a shell surface of the rotary cylinder, each actuator operating one pair of clamping members, wherein each row has at least a first and a second pair of clamping members and associated first and second actuators, and at least one control member driving the actuators to operate the pairs of clamping members into gripping engagement in a region of the plucking zone, whereby the first and second pairs of clamping members of each row traverse the plucking zone together in gripping engagement during cylinder rotation.

56. The rotary cylinder as claimed in claim 55, wherein the actuators move parallel to the rotational axis of the cylinder.

57. The rotary cylinder as claimed in claim 56, wherein the actuators operating the pairs of clamping members of each row are co-linear.

58. The rotary cylinder as claimed in claim 55, wherein each pair of clamping members comprises one stationary and one movable clamping member, wherein said one movable clamping member is arranged more proximal the associated control member than is said one stationary clamping member.

59. The rotary cylinder as claimed in claim 55, further comprising first and second control members disposed at respective opposed axial ends of the cylinder, wherein in each row the first actuator extends between the first control member and the first pair of clamping members and the second actuator extends between the second control member and the second pair of clamping members.

60. The rotary cylinder as claimed in claim 59, wherein each row has two pairs of clamping members and respective two actuators.

61. The rotary cylinder as claimed in claim 59, wherein each pair of clamping members comprises one stationary and one movable clamping member, the first and second control members each comprise a cam surface, and the actuators each comprise a pin driven by the respective cam surface and bearing on the respective movable clamping member.

62. The rotary cylinder as claimed in claim 61, wherein the clamping members pivot about a fulcrum disposed within the cylinder shell surface.

63. The rotary cylinder as claimed in claim 62, wherein the clamping members are rigid, thereby substantially resisting flexure during operation.

64. The rotary cylinder as claimed in claim 61, wherein the movable clamping member of each of the first and second pairs is disposed between the respective stationary clamping member of the first and second pairs and the respective first and second control members.

65. A rotary cylinder for an epilating appliance for personal use, comprising a cylinder body having opposed axial ends and a rotational axis extending therebetween, a plurality of pairs of generally elongate clamping blades disposed within the cylinder body and extending across the cylinder body, the clamping blades of each pair being in adjacent facing relation and relatively movable, each clamping blade having at least first and second terminal regions disposed at spatially separated regions of a surface of the cylinder body, each terminal region defining a clamping member, whereby two adjacent clamping members form a pair of clamping members relatively movable for plucking hair of a user in a plucking zone along a shell surface of the cylinder body, at least one control member disposed at one of said axial ends, and a plurality of actuators disposed in the cylinder body, said actuators being driven by the control member and extending from the control member to contact the pairs of clamping blades, wherein at least one clamping blade of each pair of clamping blades is contacted by at least one actuator, each said at least one actuator not contacting another clamping blade.

66. The rotary cylinder as claimed in claim 65, wherein the pairs of clamping blades comprise one stationary and one movable clamping blade.

67. The rotary cylinder as claimed in claim 65, wherein said one clamping blade of each pair of clamping blades is contacted by one said actuator at each respective terminal region, whereby each actuator of the plurality of actuators is in operative association with one pair of clamping members.

68. The rotary cylinder as claimed in claim 65, wherein said one clamping blade of each pair of clamping blades is contacted by two actuators at respective first and second terminal regions.

69. The rotary cylinder as claimed in claim 68, further comprising a fulcrum disposed between said first and second terminal regions, whereby the one clamping blade pivots about the fulcrum.

70. The rotary cylinder as claimed in claim 69, wherein the actuators comprise push rods, and the control member comprises a first cam surface raised above a neutral plane of the control member extending in a direction axially inwards of the cylinder body and a second cam recess surface below the neutral plane extending outwards of the cylinder body, whereby as the first cam surface displaces the first of the two actuators contacting the one clamping blade of each pair of clamping blades, the clamping blade urges the second of the two actuators towards the second cam recess surface.

71. The rotary cylinder as claimed in claim 65, wherein the clamping blades extend generally diametrally across the cylinder body.

72. The rotary cylinder as claimed in claim 65, wherein the clamping blades are rigid and the one clamping blade of each pair of clamping blades pivots into plucking engagement.

73. The rotary cylinder as claimed in claim 65, wherein the control member comprises a cam surface and the actuators comprise rods.

74. The rotary cylinder as claimed in claim 65, wherein adjacent pairs of clamping blades are angularly offset relative one another about the rotational axis, said adjacent pairs being adjacent in a direction of the rotational axis.

75. The rotary cylinder as claimed in claim 65, wherein two pairs of clamping members are arranged in each of a plurality of axial rows, said rows extending generally parallel to the rotational axis, thus said two pairs traversing the plucking zone simultaneously, and further comprising two said control members, one control member disposed at each axial end, whereby a first portion of the plurality of actuators is disposed between the first control member and a first portion of the plurality of pairs of clamping blades, and a second portion of the plurality of actuators is disposed between the second control member and a second portion of the plurality of pairs of clamping blades.

76. The rotary cylinder as claimed in claim 75, wherein said one clamping blade of each pair of clamping blades is contacted by one said actuator at each respective terminal region, whereby each actuator of the plurality of actuators is in operative association with one pair of clamping members.

77. A modular rotary cylinder for an epilating appliance for personal use, comprising a plurality of disks forming a cylinder body, each disk comprising front and rear faces joined by a circumferential surface around a rotational axis between the front and rear faces, each face defining a groove extending across the face, a movable clamping blade received in the front face groove and a stationary clamping blade received in the rear face groove, wherein each pair of adjacent disks has the front face groove of a first disk in register with the rear face groove of a second disk, and wherein adjacent pairs of movable and stationary clamping blades disposed between registering grooves define pairs of clamping members proximal the adjacent circumferential surfaces, and a plurality of actuators received in the rotary cylinder contacting the clamping blades and adapted to by driven by a control member, whereby an axial length of the modular rotary cylinder is selected by assembling the pairs of disks.

78. The rotary cylinder as claimed in claim 77, wherein each disk further comprises bores defined through the front and rear faces for receiving the actuators, adjacent disks having bores in register forming channels guidingly supporting the actuators.

79. The rotary cylinder as claimed in claim 77, wherein the grooves on each front and rear face of each disk have longitudinal groove axes offset relative one another about the rotational axis, whereby adjacent pairs of disks have pairs of clamping members angularly offset along the circumferential surfaces.

80. The rotary cylinder as claimed in claim 77, wherein each disk has at least one groove inclined relative to a plane perpendicular to the rotational axis, whereby the adjacent pairs of movable and stationary clamping blades form pairs of clamping members axially offset along the rotational axis, whereby said pairs of clamping members epilate a region of skin that varies in time as the clamping members traverse the skin during cylinder rotation.

81. The rotary cylinder as claimed in claim 77, wherein each disk further comprises at least one fulcrum formed on one of the faces, the fulcrum pivotally supporting the movable clamping blade.

82. The rotary cylinder as claimed in claim 77, wherein the grooves extend diametrally across the disk faces.

83. The rotary cylinder as claimed in claim 77, further comprising a first and a second plurality of said pairs of disks, a center disk having front and rear faces joined by a circumferential surface around a rotational axis between the front and rear faces, each face defining a groove extending across the face and receiving a stationary clamping blade, each said first and second pluralities of said pairs of disks disposed adjacent opposite faces of the center disk, each said plurality having one front face groove in which is disposed the movable clamping blade in register with the center disk groove in which is disposed the stationary clamping blade, one control member disposed at each opposed axial end of the rotary cylinder and driving the respective actuators of the first and second pluralities of said pairs of disks.

84. A rotary cylinder for an epilating appliance for personal use, comprising a shell surface surrounding a rotational axis, the shell surface defining at least one hair guiding channel, the channel bounded by first and second channel walls in spaced facing relation, and extending in an axial direction in a manner of a screw thread about the rotational axis, and a plurality of pairs of clamping members relatively movable into and out of hair gripping engagement in a plucking zone of the shell surface, the hair guiding channel intersecting at least a portion of the plurality of pairs of clamping members, whereby during rotation of the cylinder hair of skin of a user to be depilated is guidingly supported into the pairs of clamping members.

85. The rotary cylinder as claimed in claim 84, wherein the plurality of pairs of clamping members is disposed within the hair guiding channel, whereby during cylinder rotation the pairs of clamping members gripping the hair vary in axial position along the plucking zone.

86. The rotary cylinder as claimed in claim 85, wherein at least three pairs of clamping members are disposed within an extent of the hair guiding channel through 360° about the rotational axis.

87. The rotary cylinder as claimed in claim 84, wherein at least one of the first and second channel walls is substantially continuous around the rotational axis.

88. The rotary cylinder as claimed in claim 85, wherein at least one clamping member of each pair of clamping members is disposed parallel adjacent one of the first and second channel walls.

89. The rotary cylinder as claimed in claim 84, wherein at least one of the first and second channel walls further comprises a plurality of wedge-shaped portions adjacent the pairs of clamping members and defining a throat having width similar to a width of the adjacent pair of clamping members in an out of hair gripping engagement position.

90. The rotary cylinder as claimed in claim 84, further comprising at least two hair guiding channels and branch channels linking the at least two hair guiding channels.

91. The rotary cylinder as claimed in claim 84, further comprising at least two hair guiding channels, each extending in opposed axial directions.

* * * * *